US007137234B2

(12) United States Patent
Caporali et al.

(10) Patent No.: US 7,137,234 B2
(45) Date of Patent: Nov. 21, 2006

(54) VERTICAL FLAT STACKING APPARATUS AND METHOD OF USE

(75) Inventors: Michael E. Caporali, Endicott, NY (US); Bruce H. Hanson, Endicott, NY (US); Shane F. Mills, Owego, NY (US); J. Edward Roth, Lansdale, PA (US); Michael A. Wisniewski, Owego, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/715,515

(22) Filed: Nov. 19, 2003

(65) Prior Publication Data

US 2004/0098948 A1 May 27, 2004

Related U.S. Application Data

(60) Provisional application No. 60/427,184, filed on Nov. 19, 2002.

(51) Int. Cl.
*B65B 35/24* (2006.01)
*B65B 5/10* (2006.01)

(52) U.S. Cl. ..... 53/433; 53/447; 53/475; 53/55; 53/249; 53/255; 53/259; 53/260

(58) Field of Classification Search ..... 53/443, 53/447, 475, 55, 249, 255, 259, 260; 209/900; 271/207, 217, 250, 251; 414/791.1, 794.4
See application file for complete search history.

(56) References Cited

U.S. PATENT DOCUMENTS 2,713,959 A * 7/1955 Gilbert et al. ..... 53/540
3,229,444 A * 1/1966 Rouse ..... 53/245
4,156,482 A 5/1979 Tomlinson et al.
4,256,222 A 3/1981 Gunti
4,274,780 A 6/1981 Kaul et al.
4,681,502 A * 7/1987 Staufner ..... 414/795.8
4,790,424 A 12/1988 Tomlinson
4,938,007 A * 7/1990 Sperry ..... 53/449
4,997,176 A * 3/1991 Hain ..... 271/180
5,035,164 A * 7/1991 Cremona ..... 83/80
5,135,352 A * 8/1992 Scata et al. ..... 414/798.8
5,143,225 A 9/1992 Rabindran et al.
5,280,694 A * 1/1994 Malow ..... 53/475
5,290,025 A 3/1994 Plent et al.
5,419,457 A 5/1995 Ross et al.
5,503,388 A * 4/1996 Guenther et al. ..... 271/300
5,542,547 A * 8/1996 Ricciardi ..... 209/539
5,626,236 A 5/1997 Hiebert (Continued)

*Primary Examiner*—Scott A. Smith
*Assistant Examiner*—Gloria R. Weeks
(74) *Attorney, Agent, or Firm*—Greenblum & Bernstein, P.L.C.

(57) ABSTRACT

A device and method for stacking product into a container in a vertical orientation. The device includes at least one pivoting mechanism pivotable between a loading position and an initial/final position. The at least one pivoting mechanism retains a container thereon. The device may further include at least one corresponding diverting mechanism for injecting product into the container. The diverting mechanism includes a feeding area and a diverting arm swingable between an open position and a closed position. In the open position, the diverting arm allows product to enter the feeding area. An ejection station is positioned proximate to the feeding area and injects the product into the container after the product enters the feeding area via movement of the diverting arm. In one aspect the ejection station is provided by a pinch belt arrangement and is controlled by a control.

25 Claims, 7 Drawing Sheets

U.S. PATENT DOCUMENTS 5,692,877 A 12/1997 Sixtensson
5,778,640 A * 7/1998 Prakken et al. ..... 53/475
5,791,867 A 8/1998 Kuhl
5,906,468 A * 5/1999 Vander Syde et al. ..... 414/403
6,152,683 A 11/2000 Linder
6,328,302 B1 12/2001 Hendrickson et al.
6,438,928 B1 * 8/2002 Huang et al. ..... 53/473
6,468,024 B1 10/2002 Bishop et al.
6,666,450 B1 * 12/2003 Slocum et al. ..... 271/218
2003/0108416 A1 * 6/2003 Schererz et al. ..... 414/794.4

* cited by examiner

VERTICAL FLAT STACKING APPARATUS AND METHOD OF USE

CROSS REFERENCE TO RELATED APPLICATIONS

This application claims priority to U.S. provisional application Ser. No. 60/427,184, filed on Nov. 19, 2002, which is now incorporated by reference in its entirety herein.

BACKGROUND OF THE INVENTION

1. Field of the Invention

The invention generally relates to a stacking device and, more particularly, to a device for vertically stacking product such as mail objects in a sequenced order within a container and a method of use.

2. Background Description

The sorting of mail objects is a very complex, time consuming task. In general, the sorting of mail objects is processed though many stages, including back end processes, which sort or sequence the mail in delivery order sequence. These processes can either be manual or automated, depending on the mail sorting facility, the type of mail to be sorted such as packages, flats, letters and the like. A host of other factors may also contribute to the automation of the mail sorting, from budgetary concerns to modernization initiatives to access to appropriate technologies to a host of other factors.

In general, however, most modern facilities have taken major steps toward automation by the implementation of a number of technologies. These technologies include, amongst others, letter sorters, parcel sorters, advanced tray conveyors, flat sorters and the like. As a result of these developments, postal facilities have become quite automated over the years, considerably reducing overhead costs.

But, in implementation, problems still exist. For example, currently, product such as mail objects is initially provided in an unsorted condition. The mail objects are conveyed about any known type of transport system such as a monorail type transport or other known carousel system. In the monorail type system, for example, several hundred drop-off or unloading points are located along the travel path of the trays, with chutes providing a pathway between transporting trays and containers located at each drop off point. At respective "drop off" or unloading points, the mail objects are unloaded into a respective container via the chutes in a sequenced order. That is, the mail objects are slid down the chutes into the containers and are stacked in a horizontal stacking order within the containers. The unloading point is typically determined by a code placed on the mail object associated with a delivery point or address of the mail object, any of which may be read by an optical reader or bar code reader or the like prior to or during the transporting of the mail object, itself. Any well-known algorithm may be utilized to process the product to a respective unloading point.

Although the mail objects are provided within the container in a sorted manner and, in implementations, in a delivery order sequence, there is a tendency that the mail objects, after being placed within the containers, may lose their sequence integrity. This is basically due to the fact that the mail objects are sorted in a horizontal stack within the containers, themselves. In a horizontal stacking order, the mail objects can shift out of sequence with respect to one another, especially during the transporting of the mail objects by the mail carrier during the delivery of such mail objects. In some instances, the mail carrier will reorient the horizontal stack into a vertical orientation to more easily detect "break points"; however, this may disrupt the sequence integrity of the mail objects.

If the mail objects lose their sequence integrity, it becomes much more time consuming for the mail carrier to properly delivery the mail objects and, in instances, the mail objects may have to again be sequenced, but during the delivery thereof. This adds to the delivery time and, ultimately, the cost of delivery of the mail objects. It also may lead to the improper delivery of the mail objects or mail objects being undeliverable.

The invention is directed to overcoming one or more of the problems as set forth above.

SUMMARY OF THE INVENTION

In a first aspect of the invention, the device includes at least one pivoting mechanism pivotable between a loading position and an initial/final position. The at least one pivoting mechanism retains a container thereon. The device further includes at least one corresponding diverting mechanism for injecting product into the container. The at least one corresponding diverting mechanism includes a feeding area and a diverting arm swingable between an open position and a closed position. In the open position, the diverting arm allows product to enter the feeding area. An ejection station is positioned proximate to the feeding area and injects the product into the container after the product enters the feeding area via movement of the diverting arm. In one aspect, the ejection station is a pinch belt arrangement and is controlled by a control system.

In another aspect of the invention, the device includes at least one pivoting mechanism and at least one corresponding diverting mechanism for injecting product into a container. The at least one corresponding diverting mechanism includes a feeding area and an ejection station comprising a pinch belt configuration that allows injection of the product into the container.

In another aspect, a mechanism for vertical stacking of product includes a container positioner constructed to rotate a container between a horizontal configuration and an inclined configuration. A control is operable for activating the container positioner to rotate the container from the horizontal configuration to the inclined configuration to permit product to drop in a substantially horizontal orientation into the container receptacle, and to rotate the container to position each product from the horizontal orientation to the substantially vertical orientation.

In another aspect, a method is provided for stacking product in a vertical orientation. The steps include transporting a container; angling the container to a predetermined angle greater than 0 degrees from a horizontal plane; injecting product into the container in a vertically stacked orientation; indexing the container a predetermined distance; continuing injecting product into the container in a vertically stacked orientation; lowering the container into the horizontal plane; and transporting the container in the substantially horizontal plane away from an area of the injecting.

In another aspect, a method is provide for dropping product in a substantially horizontal orientation in a travel path and for depositing the product into a container in a substantially vertical orientation. The method comprises rotating the container from a horizontal configuration to an inclined configuration and dropping product in a substantially horizontal orientation into the container. The container is rotated from the inclined configuration to the horizontal configuration to position each product in the container from the horizontal orientation to the substantially vertical orientation.

DETAILED DESCRIPTION OF EMBODIMENTS OF THE INVENTION

The invention is directed to a product stacking apparatus and more particular to a device capable of stacking product such as mail objects in a vertical orientation in a container or mail tub (rather than stacked in the traditional horizontal orientation). The invention also relates to a method of stacking product into a sequenced stack for future delivery or warehousing or the like. In aspects of the invention, the products may be stacked within the container in a vertical orientation into separate compartments within the container, itself. In further aspects of the invention, the stacking of the products, using the device of the invention, will maintain delivery sequence integrity for delivery by a mail carrier for a specific mail carrier route. By way of one illustration, the device and method of the invention significantly reduces or eliminates the shifting of the products out of sequence within the container, itself. This may be due gravity and pressure from the adjacent faces of each article holding the articles in the upright and vertical orientation. Compartments within the container may also be used to contribute to the maintenance of the pieces within a vertical orientation. Other applications such as warehousing and storage applications are also contemplated for use with the invention.

Stacking Device

Figure 1B:
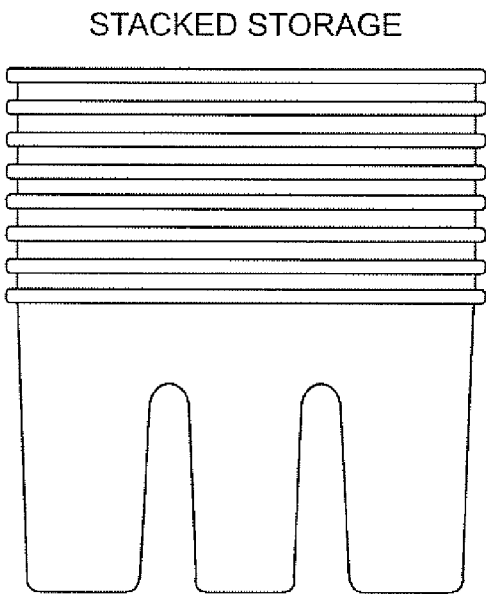
FIGS. 1*a* and 1*b* show a container implemented with the invention.
Figure 1A:
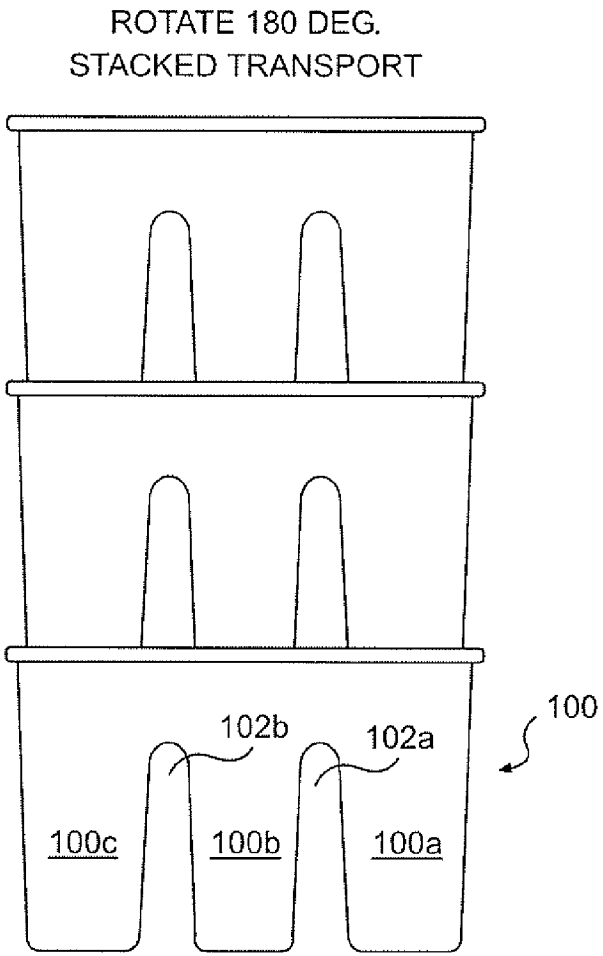

Referring now to FIG. 1*a*, a container implemented with the invention is provided. The container is generally depicted as reference numeral 100 and includes three separate compartments 100*a*, 100*b* and 100*c*, each divided by an upward projection 102*a* and 102*b*. These projections may either be molded into the container, itself, or may be separate inserts which may assist in the partial filling of the containers in accordance with the invention.

The compartments are designed to hold a number of mail objects. In an empty state, the containers 100 may be nested, as shown in FIG. 1*b*. It should be understood by those of ordinary skill in the art that the containers shown in FIGS. 1*a* and 1*b* are one type of container which may be implemented with the invention. Thus, the representation of the container 100 in FIGS. 1*a* and 1*b* should not be considered a limiting feature of the invention. For example, other types of containers may also be used with the invention such as, for example, containers with more or less than three compartments or containers which do not have any compartments.

Figure 2:
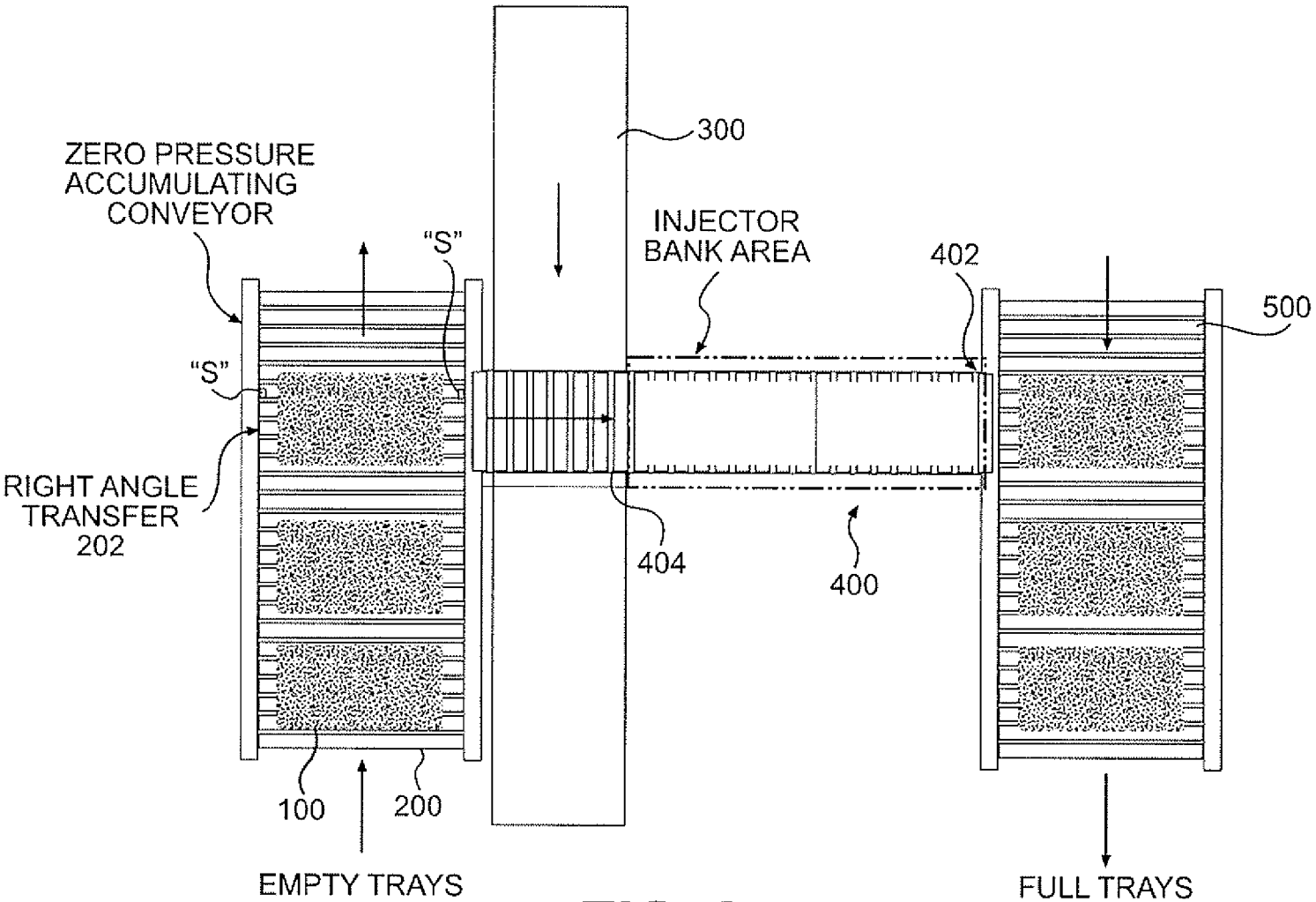
FIG. 2 shows a top view of an implementation in accordance with the invention.

FIG. 2 is a top view of an implementation in accordance with the invention. In FIG. 2, a zero pressure accumulating conveyor 200 may be provided at a right angle to a carousel type sorting device or other known type sorting mechanism 300. The carousel type sorting device 300 sorts the product in a delivery point sequence in any known manner such as, for example, using a two pass algorithm technique. By way of illustration, known to those of ordinary skill in the art, codes on the product will be read by an optical reader or bar code scanner, for example, in order to arrange the product in a sequence. The sorting device may be any known device such as systems manufactured by Lockheed Martin Corporation, Siemens Corporation, Northrop Grumman Corporation, Pitney Bowes, NEC or Toshiba to name by a few. The invention may be easily implemented with any of these systems, none of which should be considered a limiting feature of the invention.

Referring again to the conveyor 200, it should be understood that the conveyor 200 may be any type of known conveyor such as a belt conveyor or an individually controlled roller conveyor, all well known in the field of transporting devices. In the belt conveyor or other type of known conveyor, the containers 100 are initially placed on the conveyor 200 in an empty state. The conveyor 200 includes a right angle transfer mechanism 202 which may be, for example, a source of high pressure air which moves the container 100 from the conveyor 200 to an injector bank area generally depicted as reference numeral 400. Alternatively, the right angle transfer mechanism 202 may include rollers positioned at right angles, e.g., in alignment with rollers on the injector bank area 400, to remaining rollers of the conveyor 200. Other known systems such as, for example, an actuator, hydraulic system or the like may also be implemented with the invention.

In one aspect, the right angle transfer mechanism 202 may be activated to transport the containers from the conveyor 200 to the injector bank area 400 by use of a photosensor, i.e., photo diode, or other type of sensor, generally depicted as "S", known in the art. For example, when a container 100 passes through light emitted from the photosensor, a switch will activate the right angle transfer mechanism 202. The right angle transfer mechanism 202, in turn, will then divert the container from the conveyor 200 to the injector bank area 400.

FIG. 2 further shows the injector bank area 400 with a transition roller 402, proximate to a takeaway conveyor 500. The injector bank area 400 includes the mail transport mechanism of the invention, as described with reference to FIG. 3 and FIG. 4. Similar to the conveyor 200, the conveyor 500 may be a roller or belt type conveyor or other known transporting device. In one implementation, the injector bank area 400 is positioned between the conveyor 200 and the conveyor 500, with the transition roller 402 at a right angle to the transporting direction of the conveyor 500. The conveyor 500 is designed to transport containers with product therein.

It should be understood by those of ordinary skill in the art that the injector bank area 400 may be at other angles with respect to the conveyor 200 or conveyor 500. In one implementation, the conveyors may be at an angle of less than 90 degrees, for example, by implementing an angled wall to make the transition between the conveyor 200 or 500 and the injector bank area 400. In another implementation, the injector bank area 400 may be in substantial alignment with both the conveyor 200 and conveyor 500. In this implementation, the right angle transfer mechanism 202 as well as the transition roller 402 may be eliminated.

Figure 4:
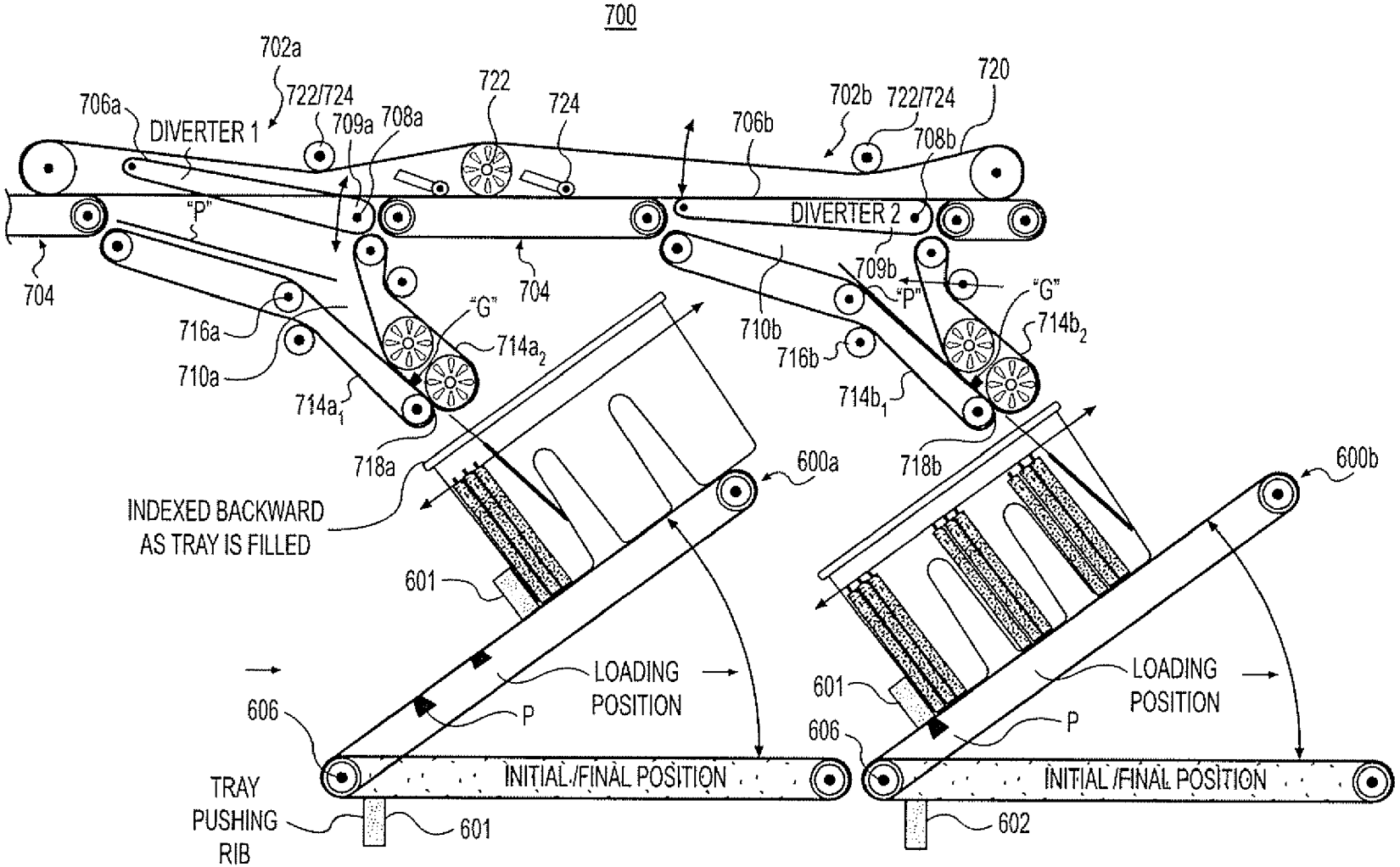
FIG. 4 shows a side view of the implementation in accordance with the invention.

Still referring to FIG. 2, a transport portion 404 is provided adjacent the injector bank area 400, and is positioned underneath or proximate to the sorting device 300. The sorting device 300, as seen in FIG. 4, may be positioned between the conveyor 200 and the conveyor 500.

Figure 3:
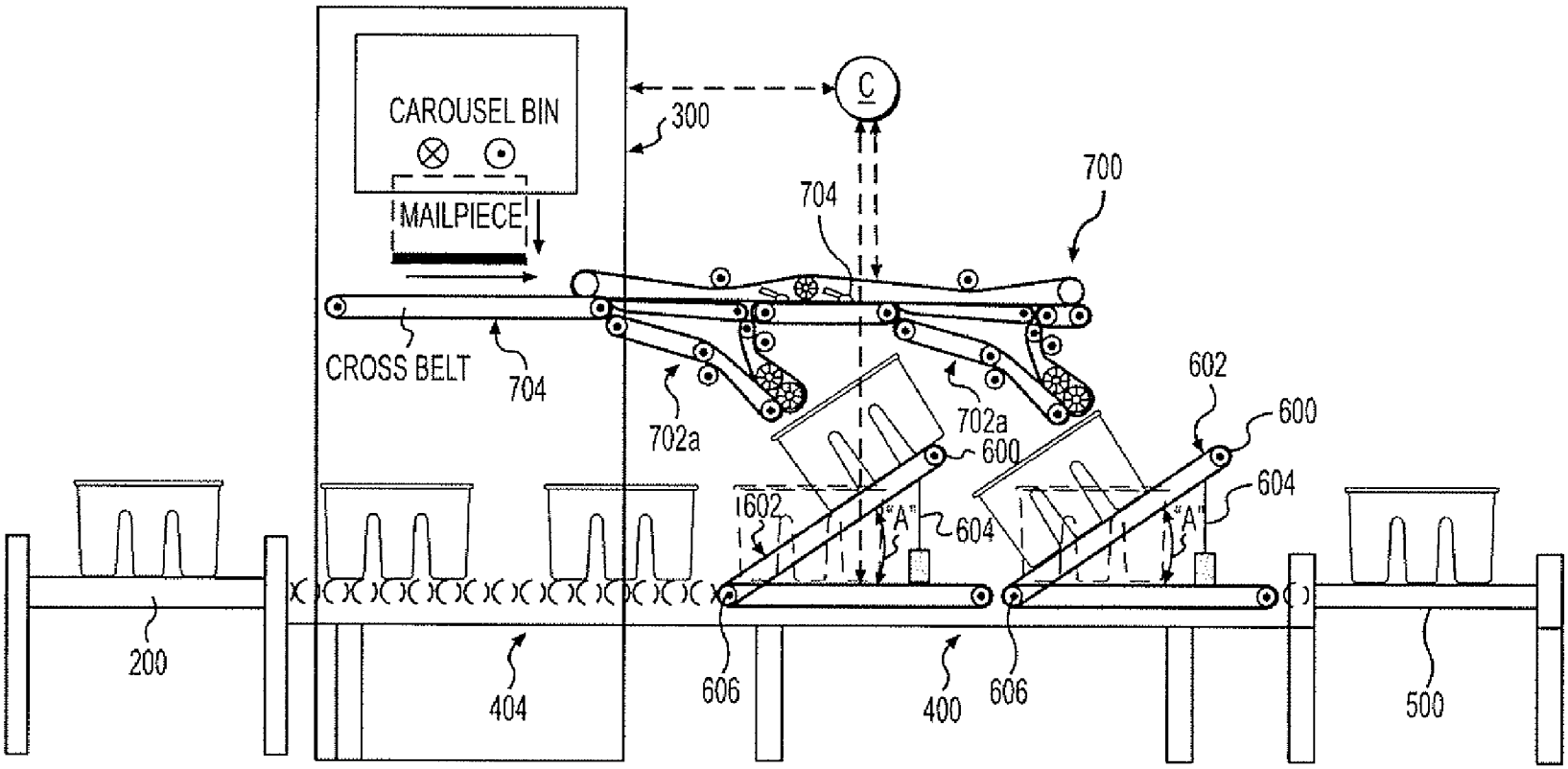
FIG. 3 shows a side view of an implementation in accordance with the invention.

FIG. 3 shows a side view of an implementation in accordance with the invention. In FIG. 3, the conveyor 200 and conveyor 500 are shown at substantially right angles with respect to the injector bank area 400. The transport portion 404 is positioned proximate to the sorting device 300 and the injector bank area 400 is positioned proximate to the transport portion 404. In one implementation, the injector bank area 400 includes at least one pivoting conveyor mechanism 600 which includes transport rollers or belts 602. In aspects of the invention, two or more pivoting conveyor mechanisms 600 may be provided with the invention, depending on the desired capacity of the system.

The pivoting conveyor mechanism 600 is positionable between a substantially horizontal position (downward position), e.g., in a substantially same plane with the conveyor 300 and conveyor 500 (FIG. 2), and an upright or loading position (FIG. 3) as depicted by arrow "A". In the loading position, the pivoting conveyor mechanism 600 may be positioned at an angle of approximately 35 degrees or less with respect to the plane of the conveyor 200 and conveyor 500. In one implementation, the pivoting conveyor mechanism 600 may be at a greater angle than 35 degrees so long as the container 100 can be retained thereon in the loading position, e.g., approximately 45 to approximately 90 degrees. To accomplish this, the belts or rollers or other transporting devices may be coated with a friction enhancing material such as, for example, the use of anti-skid paints well known in the industry, or teeth or lugs protruding from the belt. Alternatively, the weight of the container, itself, in addition to the products stacked therein, may provide an additional means for retaining the container on the pivoting conveyor mechanism 600, when in the loading position.

Still referring to FIG. 3, in one implementation, the pivoting conveyor mechanism 600 may be pivoted between the loading position and the down position by a piston/cylinder assembly 604, for example, positioned at an end remote from a hinged portion 606. In other aspects of the invention, the pivoting conveyor mechanism 600 may equally be pivoted by a scissor type lift, a linear actuator, a belt driven mechanism or other lifting type mechanism such as, for example, a pulley or lift system (generally referred to hereinafter as a lifting mechanism).

To activate the lifting mechanism, a control "C" may communicate between the sorting device 300, a transport system 700 and the pivoting conveyor mechanism 600. In one illustration, the control "C" maintains track of the product being ejected from the sorting device 300, by keeping, for example, track of the thickness of each ejected product. The control "C", in conjunction with the photodiode "S", for example, may also maintain a count or known position of the container in conjunction with a known time and distance between the conveyor 200 and bank area 400. When an empty container 100 is placed on the pivoting conveyor mechanism 600, the lifting mechanism will be activated in order to place the pivoting conveyor mechanism 600 in the loading position.

The lifting mechanism of the pivoting conveyor mechanism 600 can also be activated by use of a photodiode "$P_1$" located on or near the pivoting conveyor mechanism. For example, when the container is placed at the proper location, the container will block light emitted from the photodiode thus instructing the control "C" to activate the lifting mechanism of the pivoting conveyor mechanism 600. The photodiode or other type of sensor may communicate directly with the lifting mechanism 604 of the pivoting conveyor mechanism 600 to provide activation of the lifting mechanism. When the container is full, as determined by the control "C", in conjunction with a known thickness of the product or a determination of end and of sort, the lifting mechanism may then lower the pivoting conveyor mechanism.

As the product is placed in the container 100, the pivoting conveyor mechanism 600 may be incrementally lowered or completely lowered when the control "C" determines that an adequate amount of product is placed within the container. Alternatively, the control "C" may determine that the last product for the sequence is stacked into the container and thus control the pivoting conveyor mechanism 600 to the downward position. The conveyor portion 602 of the pivoting conveyor mechanism 600 will then transport the container to the conveyor 500 for further processing, if applicable, or for future delivery.

FIG. 3 further shows the transport system 700 . The transport system includes divert mechanisms 702*a* and 702*b* substantially aligned with each of the pivoting conveyor mechanisms 600. In one implementation, the divert mechanisms will correspond in number to the pivoting conveyor mechanisms 600. In addition, the transport system 700 further includes conveyor systems 704, one located prior to the first divert mechanism 702*a* and another positioned between adjacent divert mechanisms 702*a* and 702*b*, respectively. It should be understood that more conveyor systems 704 may be provided, depending on the amount of pivoting conveyor mechanisms 600 and corresponding divert mechanisms. The conveying system 704, for example, may include a continuous belt driven mechanism or individual rollers. The invention is also modular such that additional pivoting conveyor mechanisms 600 and divert mechanisms can easily be fitted to the system in order to expand the capacity and throughput.

FIG. 4 is an exploded view of the transport system 700 and pivoting conveyor mechanism 600. In this illustration, the transport system 700 is shown to include a first divert mechanism 702*a* and a second divert mechanism 702*b*. However, it should be well understood that more or less divert mechanisms can be implemented by the invention, depending on the desired capacity and throughput. The divert mechanisms 702*a* and 702*b* correspond to the respective pivoting conveyor mechanisms 600*a* and 600*b*, and each include a pivoting diverting arm 706*a* and 706*b*. The pivoting diverting arms 706*a* and 706*b* are pivotable about a hinged mechanism 708*a* and 708*b*, respectively.

The pivoting diverting arms 706*a* and 706*b* are capable of pivoting between a first position and a second position by a linear actuator 709*a* and 709*b* or other well known mechanism such as, for example, those mechanisms described above. In one implementation, the diverting arm 706*a* is in the first or loading position which enables a product "P" to be transported to a catcher's mitt area 710*a* formed by continuous belts 714$a_1$ and 714$a_2$, driven by rollers 716*a*. The other diverting arm 706*b* may be in the second or closed position which prevents the product from entering the catcher's mitt area 710*b*, also formed by continuous belts 714$b_1$ and 714$b_2$ driven by rollers 716*b*.

Still referring to FIG. 4, ejection stations 718*a* and 718*b* are provided for each respective diverting mechanism 702*a* and 702*b*. The ejection stations 718*a* and 718*b* each align with containers 100 on the respective pivoting conveyor mechanisms 600*a* and 600*b* and, in one implementation, are positioned proximate to the containers 100 at an angled orientation, e.g., closed position with respect to the conveyors 704. The ejection stations are formed by opposing belts of each of the catcher's mitt area 710*a* and 710*b*. In the illustration shown in FIG. 4, the continuous belts that form the ejection stations form a closed or substantially closed port such that product "P" will not be inadvertently ejected therefrom. That is, the ejection stations are formed basically by a "pinch belt" configuration which is driven by the rollers. In use, the product "P" is ejected from each of the ejection stations 718*a* and 718*b* to each of the respective containers, as controlled, for example, by the control "C", via the opposing belts of each of the catcher's mitt area 710*a* and 710*b*.

Additionally, a continuous belt 720 driven by rollers 722 are positioned proximate to the belts of the diverting arms 706*a* and 706*b* and the belts, for example, of the conveyor system 704. The belts transport the product "P" between the sorting system 300 and the divert mechanisms. Thus, as the product "P" is ejected from the sorting mechanism 300 to the conveyor system 704, the product can then be transported to the respective catcher's mitt area 710*a* and 710*b*. Thereafter, the product "P" may be ejected from the ejection stations 718*a* and 718*b* and hence injected into the containers.

It should be understood that the drive rollers throughout the system may also act as tension mechanisms in order to maintain a tension on the continuous belts. Alternatively, separate tension mechanisms such as shown generally by reference numeral 724 may also be provided with the system. The tension mechanisms 724 may also assist in providing contact to the product "P" between belts.

In one implementation, the diverting arms 706*a* and 706*b* and each of the ejection stations 718*a* and 718*b* are controlled in a coordinated manner by the control "C". For example, the control "C" may be in communication with the sorting device 300 such that the control "C" will maintain a record of the product ejected therefrom such as a thickness of each product and a number of product, for example. In this manner, the control "C", keeping track of the product, will control the movements of either of the diverting arms 706*a* and 706*b* to maintain the sequence of product. Once the product enters the appropriate catcher's mitt area, the product may then be injected into the container via the ejection stations, in one implementation controlled by the control "C".

As the product is stacked, the containers will be indexed on the pivoting conveyor mechanisms 600*a* and 600*b*, via a pusher belt mechanism 601 or the belt 602, for example. The pusher belt mechanism 601 or the belt 602 may be used to increment the container as the container becomes full, or may be used to remove the container from the banking area 400 to the conveyor 500. This can be accomplished by, again, using the control "C" to maintain a count of the product which is ejected from the ejection stations. For example, as the product "P" is ejected, the belts or rollers of the pivoting conveyor mechanism 600*a* and 600*b* will move or index the containers a set distance, substantially equivalent to several product widths.

In one implementation, the width of each product can be measured, for example, as it passes between the opposing belts of each of the ejection stations in order to index the containers a set distance or as measured at the feeders (initial stage of sorting) The measurement at the ejection station may be performed by a pressure gauge "G" which detects a deflection of the belts or movement of the belts away from each other as the product "P" passes therethrough. By measuring each mail object, it is possible to increment the containers a known distance during the vertical stacking. It is also possible to now determine when each compartment of the entire container is full to remove the container from the baking area to the transporting area. By using the device of the invention, each product will be ejected by the ejection stations into the container in a vertical stacked position, as shown in FIG. 4.

Figure 5:
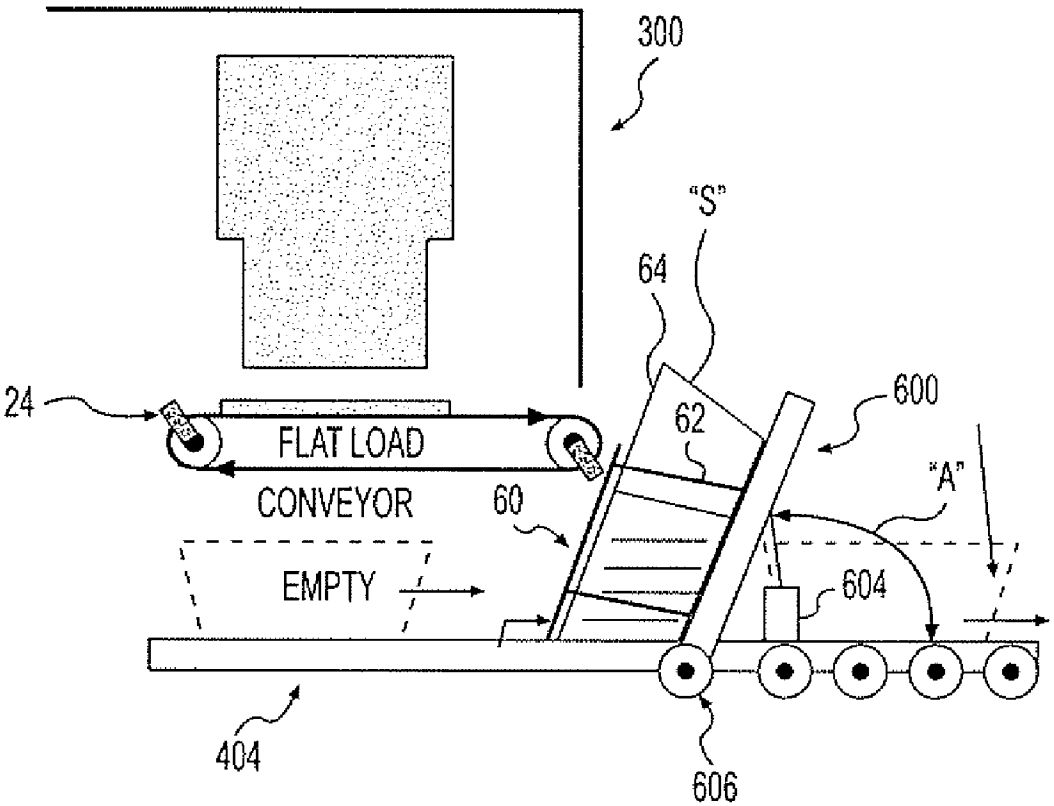
FIG. 5 shows an embodiment of an implementation in accordance with the invention.

FIG. 5 shows an embodiment of the invention. In this embodiment, the products are provided on the conveyor system from the sorting mechanism 300 in a substantially horizontal orientation. The product is transported to the container for depositing therein in a substantial vertical orientation. In one implementation, the product may be transported in a cartridge such that when the cartridge approaches a particular destination, the bottom of the cartridge may open and release onto the conveyor 704. At this time, the product generally falls in a travel path in a substantially horizontal orientation when landing on the load surface of the conveyor (e.g., article load conveyor). The load surface may be a conveyor belt or other appropriate article transfer device as would be apparent to one of skill in the art, including but not limited to a pusher or skate wheel conveyor. The conveyor may be activated by an article load driver or control "C", to laterally transport the product to the container. In one embodiment, the article load conveyor transports the articles at a rate of approximately 0.1 to approximately 4 feet per second, and in a further embodiment may transport the articles at a rate of approximately 2 feet per second.

Still referring to FIG. 5, the transport portion 404 stages or holds empty containers before they are positioned to be filled with product on the pivoting conveyor mechanism 600. When activated, either manually by an operator or by the control "C", the transport portion 404, e.g., the tray load conveyor, translates the empty container beneath the conveyor 704 onto the pivoting conveyor mechanism 600. As discussed above, the transport 404 includes a conveyor belt or other appropriate transfer device as would be apparent to one of skill in the art, including but not limited to a pusher or skate wheel conveyor.

In the embodiment of FIG. 5, the pivoting conveyor mechanism 600 includes a piston/cylinder assembly 604, for example, positioned at an end remote from or proximate to a hinged portion 606. In other aspects of the invention, the pivoting conveyor mechanism 600 may equally be pivoted by a scissor type lift, a linear actuator, a belt driven mechanism or other lifting type mechanism such as a pulley or lift system (generally referred to hereinafter as a lifting mechanism). As previously discussed the pivoting conveyor mechanism 600 is positionable between a substantially horizontal position (downward position) and an upright or loading position as depicted by arrow "A". In the loading position, the pivoting conveyor mechanism 600 may be positioned at an angle of approximately 35 degrees or less with respect to the plane of the conveyor 200 and conveyor 500. In one implementation, the pivoting conveyor mechanism 600 may be at a greater angle than 35 degrees, e.g., 45 to 90 degrees so long as the container 100 can be retained thereon in the loading position.

The pivoting conveyor mechanism 600 or the container, itself, may include a cover 60 to prevent the product from rebounding out of the container and, additionally, to retain the product within the container during phases of operation. The cover 60 is slightly shorter than the length of the container to leave an opening 64 into the container at approximately the height of the conveyor 704, thus allowing the product to be placed within the container. In aspects of the invention, the cover 60 may be fixably or removably attached to the container or the pivoting conveyor mechanism 600. The cover 60 may be attached to the container before it is loaded onto the pivoting conveyor mechanism 600 or may be attached to the pivoting conveyor mechanism 600 when it is placed in the inclined or other configuration.

In the embodiment shown in FIG. 5, the cover 60 is attached to the pivoting conveyor mechanism 600 with support members 62. The support members include, for example, extensions to support the cover on each side over the pivoting conveyor mechanism 600 at a height sufficient to allow the container to be loaded between the support members and under the cover. As the pivoting conveyor mechanism 600 is rotated to incline the container, the cover 60 rotates with the pivoting conveyor mechanism 600 and may prevent the container from over tilting.

As is shown in FIG. 5, as the container is inclined toward the conveyor 704, the container is lifted up to approximately the height of the conveyor and a top side of the container is placed approximately horizontal to become a temporary bottom of the container during loading. Thus, the angle of inclination of the container may be determined from the structure of the container, itself. Alternatively, the pivoting conveyor mechanism 600 may rotate the container to a pre-selected angle of inclination. In one embodiment, the pivoting conveyor mechanism 600 rotates the container to an angle of approximate 45 degrees. When the container is sufficiently full of product, the pivoting conveyor mechanism 600 is rotated from the inclined configuration to the horizontal position, as represented by the dashed lines of FIG. 5.

In this manner, the product, in a horizontal orientation on the loading side of the container, rotate down to rest on their edges in a vertical orientation on the bottom of the container. The container is then transported, as discussed above, to allow a new empty container to be transported onto the pivoting conveyor mechanism 600. During the container transfer, the flat sorter and other mechanisms may be stopped to prevent product from being discharged. Alternatively, the conveyor 704 may buffer or collect a short stack of product on the load surface from the flat sorter to prepare for sailing into the newly loaded, empty receptacle.

To prevent the short stack on the load surface from tipping, and possibly losing its sequence, the load surface may include at least one divider 24 to guide and maintain the stack of product on the load surface. The length of the dividers may form continuous or intermittent ribs across the width of the load surface. The dividers may have a height sufficient to support a short stack of flat articles as would be apparent to one of skill in the art. In one embodiment, the width of the dividers may be approximately 0.25 to approximately 6.0 inches wide, and in a further embodiment, may be approximately 1 inch wide.

The dividers 24 may be attached directly to the load surface through a friction or snap lock, adhesive, weld, or integral construction with the load surface. In this manner, the divider at the trailing edge of the product may prevent the product from slipping when the conveyor is initiated and may assist pushing the product into the opening 64 of the container. A plurality of dividers may be placed at predetermined locations along the length of the load surface to provide a plurality of load locations on the load conveyor. In one embodiment, the dividers may flex as they rotate around rollers of the conveyor to reduce structural damage to the conveyor and/or the dividers. The dividers are also contemplated for use with the embodiments shown in other figures.

In an alternative embodiment, the conveyor may be removed such that the sorter directly drops the product in the horizontal configuration into the container. In this manner, the opening 64 for the dropped product is now through the upper side "S" of the container. Those of skill in the art will recognize many appropriate constructions for the container such as, for example, the side "S" may be manually or automatically removed, slid open, rotated open, or formed through the side of the container. In one embodiment, the opening may be closed when the container is in the horizontal configuration to retain product within the container during transport.

Figure 6:
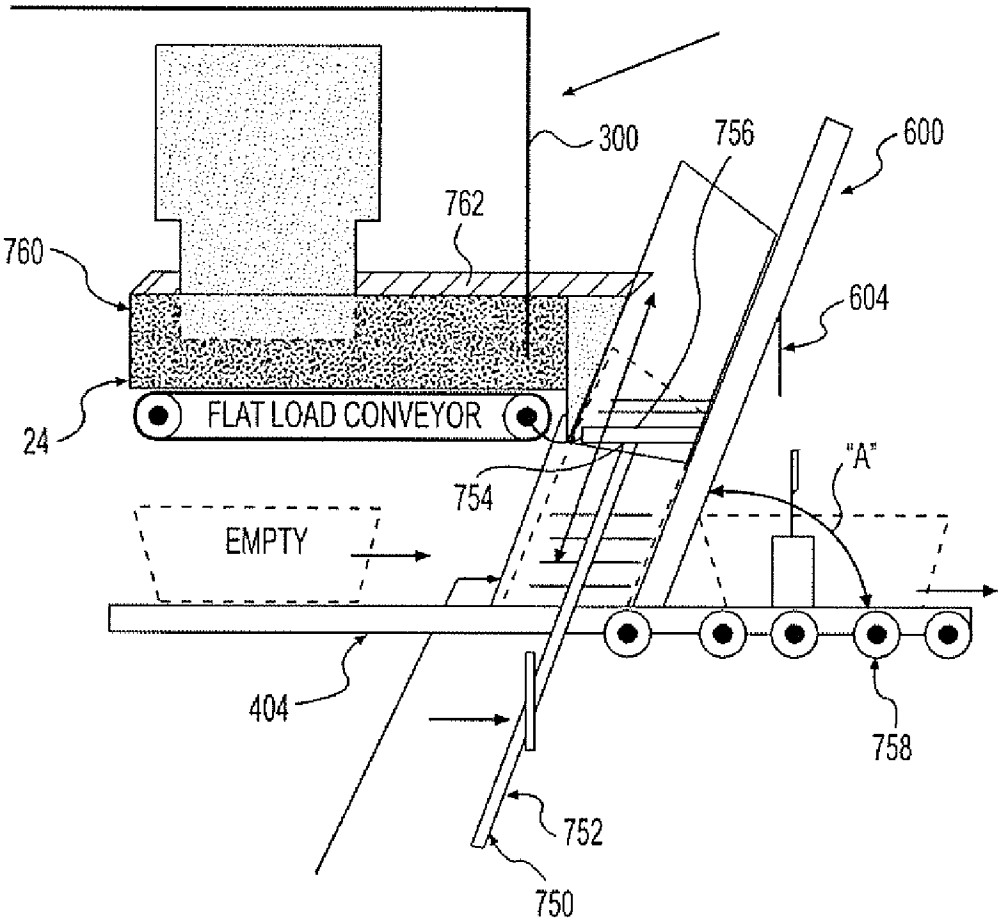
FIG. 6 shows an embodiment of an implementation in accordance with the invention.

FIG. 6 shows a tray lifting and lowering mechanism 750 associated with the pivoting conveyor mechanism 600. The tray lifting and lowering mechanism 750 includes, for example, a hydraulic lift 752 and a support plate 754. The lifting and lowering mechanism 750 can also include other types of lifting mechanisms such as, for example, linear actuators, rack and pinion gears, a servo motor or other electronic or pneumatic devices capable of supporting and moving the container and the like. The lifting and lowering mechanism 750 may be incrementally controlled by the control "C". The plate 804 is, in one embodiment, initially, when in the down position, a same plane as the transport system 404, and may include a pivoting mechanism 756 to accommodate different angles of the container as the incline angle of the pivoting conveyor mechanism 600 changes in response to the loading of the product in the container.

The lifting and lowering mechanism 750 will initially lift the container to a height of the conveyor 704 or the sorting machine 300 to begin the loading of the product into the container. In one aspect, the lifting and lowering mechanism 750 will lift the container such that a bottom surface of the container is about the same height as the conveyor 704.

The lifting and lowering mechanism 800 incrementally lowers as the product fills the container. This may be necessary to maintain a controlled drop distance for the product as it is inserted into the container. Additionally, this may be needed to incorporate the use of vertical stacking inserts into the container, which are, in embodiments, used to maintain the integrity of the product within the container when the container is not completely full of product.

The lifting and lowering mechanism 800 may be controlled by the control "C" and may be lowered an appropriate distance as the product is inserted within the container. The lowering of the lifting and lowering mechanism 800 may be controlled by a measured thickness of the product being stacked within the container. When the container is full, the lifting and lowering mechanism 800 moves out of the way and a tray sweep may take place, removing the container via a skate wheel conveyor 758, which may be used in another of the embodiments described herein. An empty container will then be located at the pivoting conveyor mechanism 600.

FIG. 6 further shows mail guides 760 associated with the conveyor 704. In this aspect of the invention, the mail guides 760 will, in embodiments, maintain the product in a proper order. For example, in some implementations, when product is dropped onto the conveyor it can skew, creating the potential for the product to hit the side of the container as it is injected into the container. To reduce the risk of improper sorting and stacking, the guides 760 are provided to ensure that the product is placed in the tray, in order. This eliminates the possibility of the product striking the edge of the container and rotating, or stopping. The guides include, for example, plates forming the sides of a chute. The conveyor, itself, may form the bottom of the chute. The product is constrained by the plates and guided all the way into the container. A top 762 may be incorporated into the chute at a point where the product is placed on the conveyor.

Method of Stacking Product Using System of the Invention

The system of the invention may be used for a single carrier route at a time, multiple routes at once or for warehousing or other sequencing needs. For illustrative purposes and not to limit the invention in any manner, a single route sequencing with will be described as an illustrative example.

Figure 7:
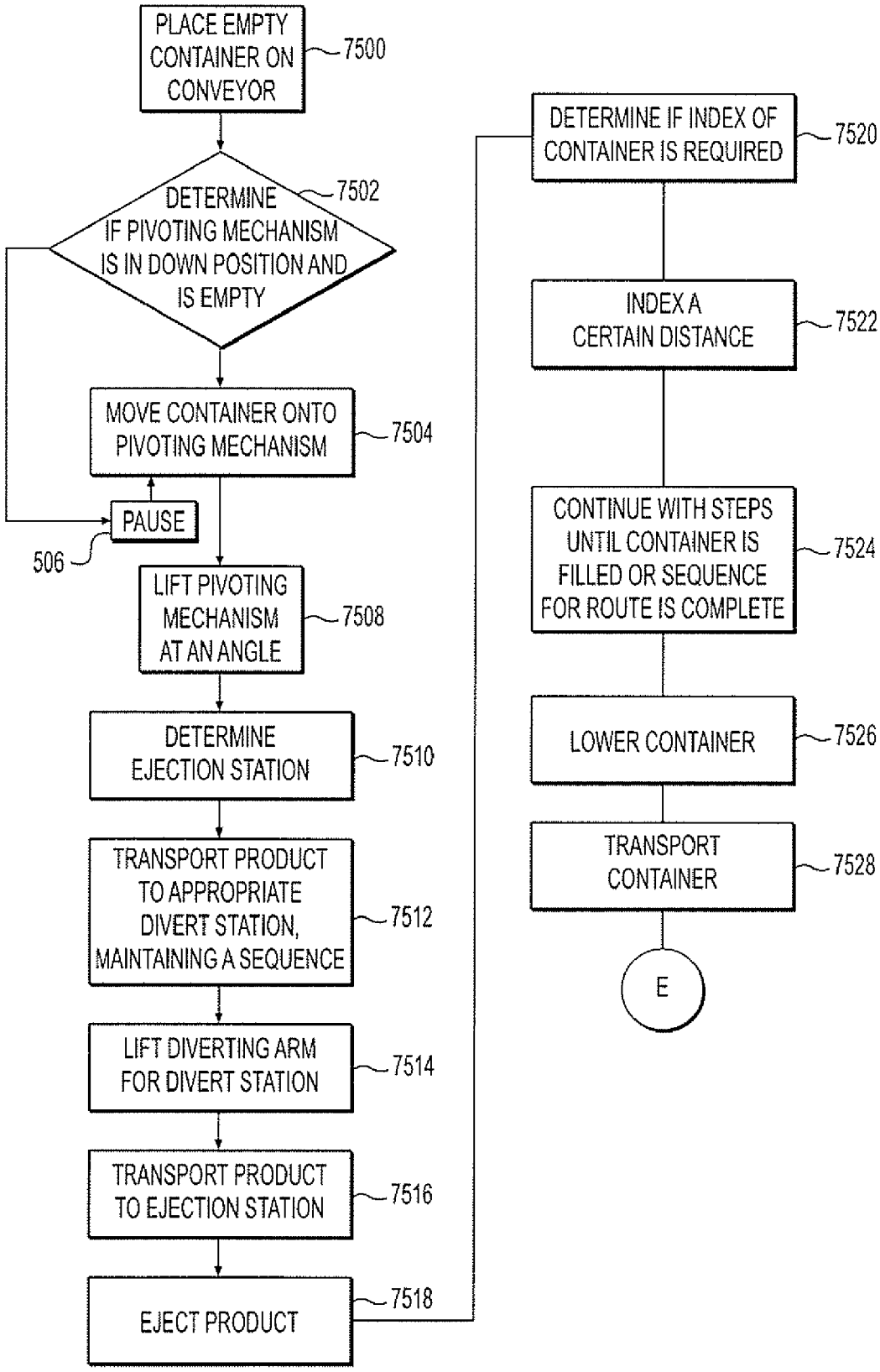
FIG. 7 is a flow diagram showing steps implementing the method of the invention.

FIG. 7 is a flow diagram showing the steps of implementing a method of the invention. The steps of the invention may be implemented on computer program code in combination with the appropriate hardware and controlled by the control "C" and monitored by the sensors, as discussed above. This computer program code may be stored on storage media such as a diskette, hard disk, CD-ROM, DVD-ROM or tape, as well as a memory storage device or collection of memory storage devices such as read-only memory (ROM) or random access memory (RAM). FIG. 5 may equally represent a high level block diagram of the system of the invention, implementing the steps thereof. Many of the steps described below may occur simultaneously.

In particular, in step 7500, an empty container is placed on the conveyor. In step 7502, a determination is made as to whether the pivoting mechanism is empty and in the down position. If yes, then in step 7504 the container is moved onto the pivoting mechanism. Such determination may be made the sensors of the invention, as described above. If not, then in step 7506 the system will pause and loop back to step 7504 once the pivoting mechanism is empty and in the down position. In step 7508, the pivoting mechanism is lifted to a predetermined angle for stacking product within the container.

In step 7510, a determination is made as to which diverting station should be used with product ejected from the sorting system. This may be accomplished, for example, by the control "C". After the determination is made, in step 7512, the product is transported to the appropriate diverting station, maintaining the sequence of the product. In step 7514, the diverting arm of the diverting station is lifted to allow the product entry to the ejection station of the diverting station. In step 7516, the product is transported to the ejection station. In step 7518, the product is ejected from the ejection station to the container, in a vertically stacked orientation due to the angle of the container and the positioning of the ejection station.

In step 7520, a determination is made as to whether the container should be indexed. If yes, then the container is indexed a certain distance in step 7522. If not, then steps 7510 through 7520 will repeat. In step 7524, the steps will continue until the container is full or a sequence for a route, for example, is complete. In step 7526, the container is lowered and, in step 7528, the container is transported from the pivoting mechanism. The process may repeat itself until all the product is stacked in the containers or the process ends, at "E".

In embodiments, the steps 7510 to 7514 may be eliminated and the product can be transported to the ejection station, directly, when only one container is used with the system. In further embodiments, the conveyor may continuously move, may move in a step wise fashion after each product is received on the load surface, or may move in a step wise fashion only after a plurality of product are collected in a stack on the load surface.

To activate the conveyor only when a stack of product having a particular height is collected, the control "C", e.g., conveyor driver, may determine the height of the collected stack. Those of skill in the art will recognize that many types of sensors, controllers, and/or software systems may be used with the conveyor driver to determine the appropriate time to activate the conveyor, including, but not limited to, timers, light sensors, weight sensors, and software in communication with the flat sorter to receive data regarding the thickness and/or weight of each deposited product. The outputs of these and additional sensors, controllers, and/or software may also be used by the control "C" to control any of the mechanism described herein such as, incrementally moving the container in an inclined orientation, lifting the container and the like, as can be practiced by those of ordinary skill in the art.

In the continuous mode, the conveyor may be left running at a constant velocity. In this mode of operation, the belt does not require a pusher and the product is dropped onto the conveyor as it is running and is conveyed to the container. The advantage to this mode of operation is that it is not necessary to potentially reject product that need to be dropped at that location, but cannot due to the fact that a pusher is in operation discharging already accumulated product. This will reduce the product rejects and improve the overall operational performance statistics.

While the invention has been described in terms of embodiments, those skilled in the art will recognize that the invention can be practiced with modification within the spirit and scope of the appended claims.

We claim as follows:

1. A device for stacking product, comprising:

at least one pivoting mechanism pivotable between a loading position and an initial/final position, the at least one pivoting mechanism retains a container thereon;

at least one corresponding diverting mechanism for injecting product into the container, the at least one corresponding diverting mechanism including:

a feeding area having an ingress and egress;

a diverting arm swingable between an open position remote from the egress of the feeding area and a closed position proximate to the egress of feeding area, in the open position, the diverting arm allowing product to enter the feeding area; and an ejection station proximate to the feeding area, the ejection station injecting the product into the container after the product enters the feeding area via movement of the diverting arm.

2. The device of claim 1, further comprising a transport system for transporting the product to the at least one corresponding diverting mechanism.

3. The device of claim 1, wherein the product is mail objects.

4. The device of claim 1, further comprising a continuous belt driven system proximate to the at least one corresponding diverting mechanism for transporting the product between a first and a second of the at least one corresponding diverting mechanisms.

5. The device of claim 1, wherein the at least one pivoting mechanism and the at least one corresponding diverting mechanism are at least two pivoting mechanisms and at least two corresponding diverting mechanisms and a transporting system additionally extends between the at least two corresponding diverting mechanisms.

6. The device of claim 1, further comprising a lifting device for lifting the at least one corresponding pivoting mechanism between the loading position and the initial/final position.

7. The device of claim 6, wherein the at least one corresponding pivoting mechanism includes a transporting device to transport the container between an induction transport and an exit transport.

8. The device of claim 1, further comprising a sensor which determines a position of the container on at least one of the at least one corresponding pivoting mechanism and an induction transport.

9. The device of claim 8, wherein the sensor is a photodiode.

10. The device of claim 1, wherein the at least one corresponding pivoting mechanism stacks the product in a vertical orientation within the container.

11. The device of claim 1, further comprising a control for controlling the movement of the diverting arm and injection of the product into the container from the ejection station.

12. The device of claim 1, further comprising an induction transport and an exiting transport positioned at respective ends of the at least one corresponding pivoting mechanism, the induction transport includes a right angle movement device for moving the container at a substantially right angle from the induction transport onto the at least one corresponding pivoting mechanism.

13. The device of claim 1, wherein the ejection station includes opposing belts configured in a pinch belt configuration.

14. A device for stacking product, comprising:

at least one pivoting mechanism pivotable between a loading position and an initial/final position, the at least one pivoting mechanism retains a container thereon;

at least one corresponding diverting mechanism for injecting product into the container, the at least one corresponding diverting mechanism including:

a feeding area;

a diverting arm swingable between an open position and a closed position, in the open position, the diverting arm allowing product to enter the feeding area; and an ejection station proximate to the feeding area, the ejection station injecting the product into the container after the product enters the feeding area via movement of the diverting arm; and a mechanism for indexing the container a predetermined distance on the at least one corresponding pivoting mechanism during injection of the product into the container.

15. A device for stacking product, comprising:

at least one pivoting mechanism pivotable between a first and second angled position;

at least one diverting mechanism corresponding to the at least one pivoting mechanism, the at least one diverting mechanism injecting product into a container and including:

a feeding area; and an ejection station comprising a pinch belt configuration that allows injection of the product into the container; and a mechanism for indexing the container a predetermined distance on the at least one corresponding pivoting mechanism during injection of the product into the container.

16. A mechanism for vertical stacking product, comprising:

a container positioner constructed to rotate a container between a horizontal configuration and an inclined configuration; and a control operable for activating the container positioner to:

rotate the container from the horizontal configuration to the inclined configuration to permit product to drop in a substantially horizontal orientation into the container receptacle, increment the container a distance during stacking of the product, and rotate the container to position each product from the horizontal orientation to the substantially vertical orientation.

17. The mechanism of claim 16, further comprising a conveyor onto which each dropped product is captured in the substantially horizontal orientation, the conveyor being constructed and arranged to drop the product into the container such that the product fall in the substantially horizontal orientation.

18. The mechanism of claim 17, further comprising a divider attached to the conveyor to retain the product in a stack, the divider additional capable of pushing the product.

19. The mechanism of claim 17, further comprising a cover removably positioned over a top of the container, the cover being attached to the container positioner and rotates with a receptacle positioner between the horizontal configuration and the inclined configuration.

20. The mechanism of claim 16, further comprising a container lifting and lowering device, the container lifting and lowering device includes a support for supporting at least a portion of a bottom of the container, the container lifting and lowering device incrementally positioning the container either upwards or downwards.

21. The mechanism of claim 16, further comprising at least one guide to guide the product into the container, in an order.

22. A method for stacking product in a vertical orientation into container, the method comprising the steps of:

transporting a container to an injection area;

angling the container to a predetermined angle greater than 0 degrees from a horizontal plane;

injecting product into the container in a vertically stacked orientation;

indexing the container a predetermined distance;

continuing injecting product into the container in a vertically stacked orientation;

lowering the container into the horizontal plane; and transporting the container away in the substantially horizontal plane away from the injection area.

23. The method of claim 22, further comprising the step determining a position of the container.

24. The method of claim 22, further comprising the step of controlling a flow of the product to an ejection area which injects the product into the container.

25. The method of claim 22, further comprising the step of determining which of several injection areas to transport the product thereto for injection into the container.

* * * * *